United States Patent [19]

Petty et al.

[11] Patent Number: 4,936,710

[45] Date of Patent: Jun. 26, 1990

[54] MOORING LINE TENSIONING AND DAMPING SYSTEM

[75] Inventors: Terry D. Petty, Kenner; William H. Rehmann, Jr., Slidell, both of La.

[73] Assignee: Odeco, Inc., New Orleans, La.

[21] Appl. No.: 355,431

[22] Filed: May 23, 1989

[51] Int. Cl.[5] ..... E02B 17/00

[52] U.S. Cl. ..... 405/224; 114/265; 405/204

[58] Field of Search ..... 405/195–200, 405/224, 203, 225; 114/264, 265

[56] References Cited

U.S. PATENT DOCUMENTS

| | | | |
|---|---|---|---|
| 2,986,889 | 6/1961 | Ludwig | 405/224 |
| 3,996,755 | 12/1976 | Kalinowski | 405/224 X |
| 4,425,056 | 1/1984 | Hunter | 405/224 |
| 4,657,438 | 4/1987 | Gillis | 405/196 X |

FOREIGN PATENT DOCUMENTS

| | | | |
|---|---|---|---|
| 2091324 | 7/1982 | United Kingdom | 405/224 |

*Primary Examiner*—Dennis L. Taylor

*Attorney, Agent, or Firm*—Michael P. Breston

[57] ABSTRACT

The floating structure comprises one or more catenary mooring cables for anchoring the structure to the seabed. An extensible dynamic tensioner system is provided for maintaining a predetermined dynamic tension in each mooring cable, as the structure responds to cyclic wave forces, and for increasing the natural periods of oscillation of the pitch, roll, heave, surge, sway, and yaw motions of the moored floating structure by reducing the spring stiffness of the mooring system. A motion damping system is coupled between the dynamic tensioner system and the structure for damping the linear and angular displacements of the structure relative to the tensioned cables. The damping system selectively applies frictional forces against a movable member in the tensioner system. The movable member does not move relative to the cables.

13 Claims, 4 Drawing Sheets

MOORING LINE TENSIONING AND DAMPING SYSTEM

This application is related to applicant's application Ser. No. 07/314,747, filed 02/24/89, now Pat. No. , and assigned to the same assignee.

BACKGROUND OF THE INVENTION

1. Field of the Invention

The present invention relates generally to motion damping of floating structures and, more particularly, to oil-and-gas drilling and production platforms using winches for deploying and pulling in one or more mooring cables.

2. Description of the Prior Art

A floating structure, for example, a drilling/production platform, is effectively a spring mass system. As such, it is subject to resonant oscillatory motions in response to wave and tidal actions in the seaway. There are six well-recognized motions: pitch, roll, heave, surge, sway, and yaw motions.

Resonant motion occurs when the natural period of a particular motion is substantially equal to the period of the wave, having substantial energy in the design seaway, which induces such motion in the platform.

The patent literature describes various structures and arrangements for dynamically and passively damping a floating platform. For example, the systems described by Bergman in U.S. Pat. No. 4,167,147 employ arrangements to create anti-heave forces that are in phase opposition and proportional to the heave velocity of the platform (Newtonian damping).

Bergman's damping system is intended to exert anti-heave forces when the vessel heaves up and also when it heaves down. These anti-heave forces are exerted on the vessel in a direction opposite to its vertical motion; they are much smaller than the actual wave forces which produce the heave; and they are intended to achieve a substantial decrease in heave amplitude, especially when the vessel is about to approach resonance.

Bergman illustrates in FIG. 14 a passive damping system which requires a tensioned flexible cable whose lower end is anchored to a weight on the sea floor. Its upper end passes over a sheave and is fixedly secured to the platform's upper deck. Also on the upper deck is a hydraulic cylinder whose piston rod supports the sheave. The cylinder is filled with pressurized oil below the piston. A restrictive orifice is interposed in the pipe between an oil supply reservoir and the cylinder to restrict the oil flow between the cylinder and the reservoir.

In deeper waters, the platform's motion responses to wave action, in particular its heave, becomes a serious problem for the production risers which are suspended by dynamic tensioning devices having a fixed stroke range.

For example, a deep-floating production platform, described in copending application Ser. No. 07/239,813, assigned to the same assignee, and now Pat. No. 4,850,744, produces oil through wellheads suspended above the waterline together with their production risers. A dynamic riser tensioner is required to ensure that each riser is constantly subjected to a constant tension. Such a deep-drafted production platform makes use of a spread-type mooring line system for anchoring the structure to the seabed. An individual winch, or the equivalent thereof, is available on the platform structure for deploying and pulling in each mooring cable.

SUMMARY OF THE INVENTION

It is an object of the present invention to use a winch, or its equivalent, not only for (a) deploying and (b) pulling in the mooring cable, but also (c) for maintaining a predetermined tension in the mooring cable under dynamic sea conditions, (d) for reducing the spring stiffness of the mooring system, thereby increasing the natural periods of oscillation of the pitch, roll, heave, surge, sway, and yaw motions of the moored floating structure, and (e) for producing anti-motion forces on the platform which are calculated to achieve a substantial decrease in a particular motion amplitude, especially when the platform is about to approach the resonance state for that particular motion.

The above five functions (a) through (e) can be conveniently achieved by utilizing and modifying a known linear winch, which had already been proposed for deploying and pulling in the mooring cable, so that such modified linear winch can, in addition, act as a dynamic mooring cable tensioner, and as a generator of anti-motion forces on the platform which are effective in assisting to maintain, within acceptable limits, the resonant motion responses of the platform to wave energies exceeding the maximum expected wave periods in a particular design seaway.

In accordance with a preferred embodiment of this invention, advantage is taken of the already proposed linear winch by selectively using it, in anticipation of a storm, for dynamically tensioning the mooring cable.

Such dynamic tensioning of the cable is designed to reduce the spring stiffness of the mooring system resulting in a desired increase in the six natural periods of oscillations of the platform.

A damping system is coupled between the floating platform and a movable dynamic member of the linear winch for damping only the platform's upward motion. This damping system can include fins having flat surfaces against which linear brakes selectively exert frictional forces, thereby increasing the dynamic tension in the mooring cable but only when the platform heaves up. This damping system becomes inactive when the structure heaves down. Such tension increases in the cable react to produce the desired downward-acting, anti-motion forces on the floating platform.

DESCRIPTION OF PREFERRED EMBODIMENTS

Many different types of floating semi-submersible structures are known and presently employed for hydrocarbon drilling and/or production, and principles of the present invention are applicable to many of these, and also to floating structures of other types. All such structures are subject to the six linear and angular resonant motions: pitch, roll, heave, surge, sway, and yaw in response to wave excitations in the design seaway.

However, the invention will be better understood from a description of its utility in applicant's platform 10, which is more fully described and claimed in copending application, Ser. No. 07/239,813, filed Sept. 2, 1988, now U.S. Pat. No. 4,850,744 and which is incorporated herein by reference.

The Prior Platform

Figure 1:
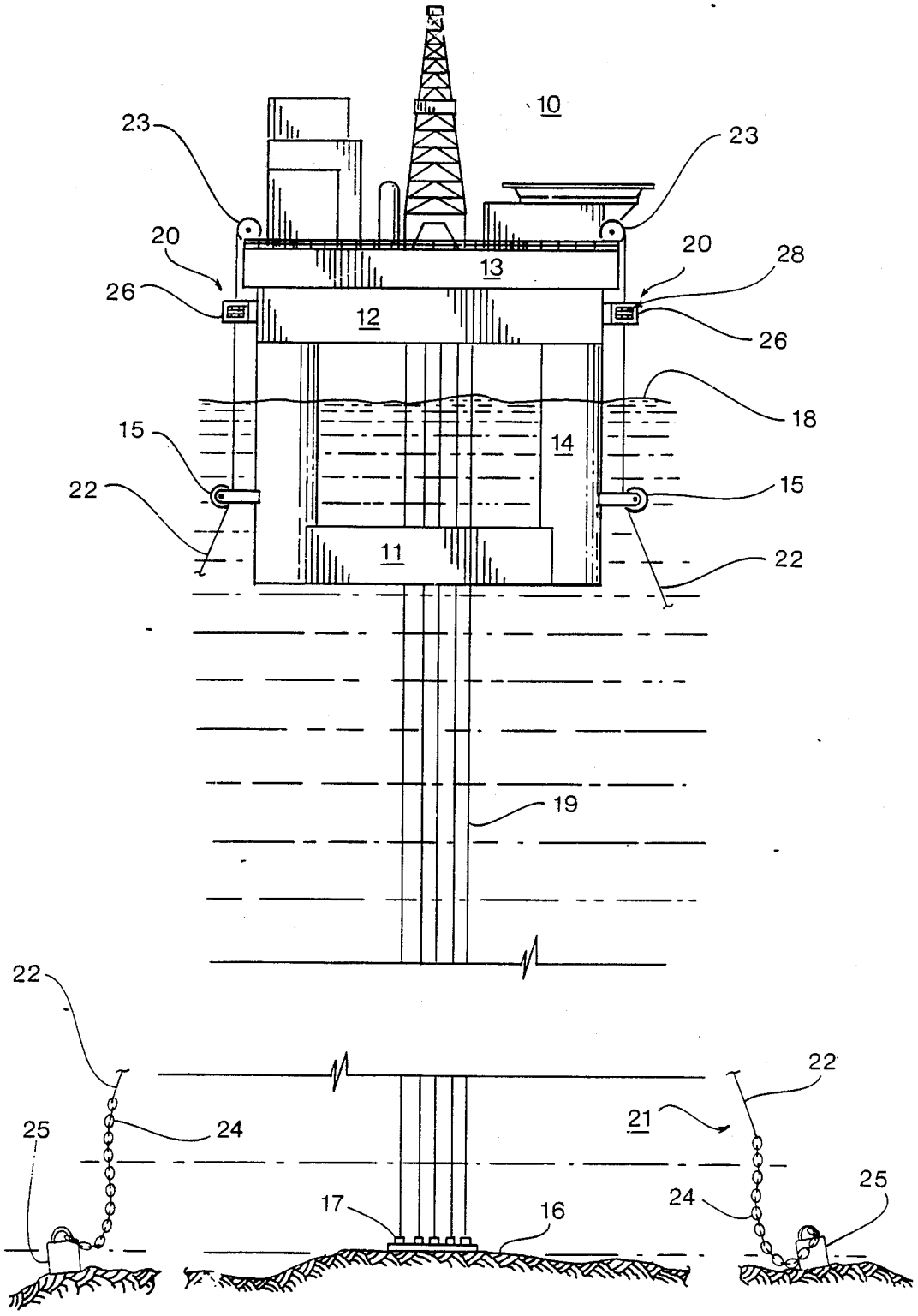
FIG. 1 is a schematic side elevation view illustrating applicants' prior semi-submersible floating production platform equipped with the novel mooring cable tensioning and damping system of the present invention.
Figure 2:
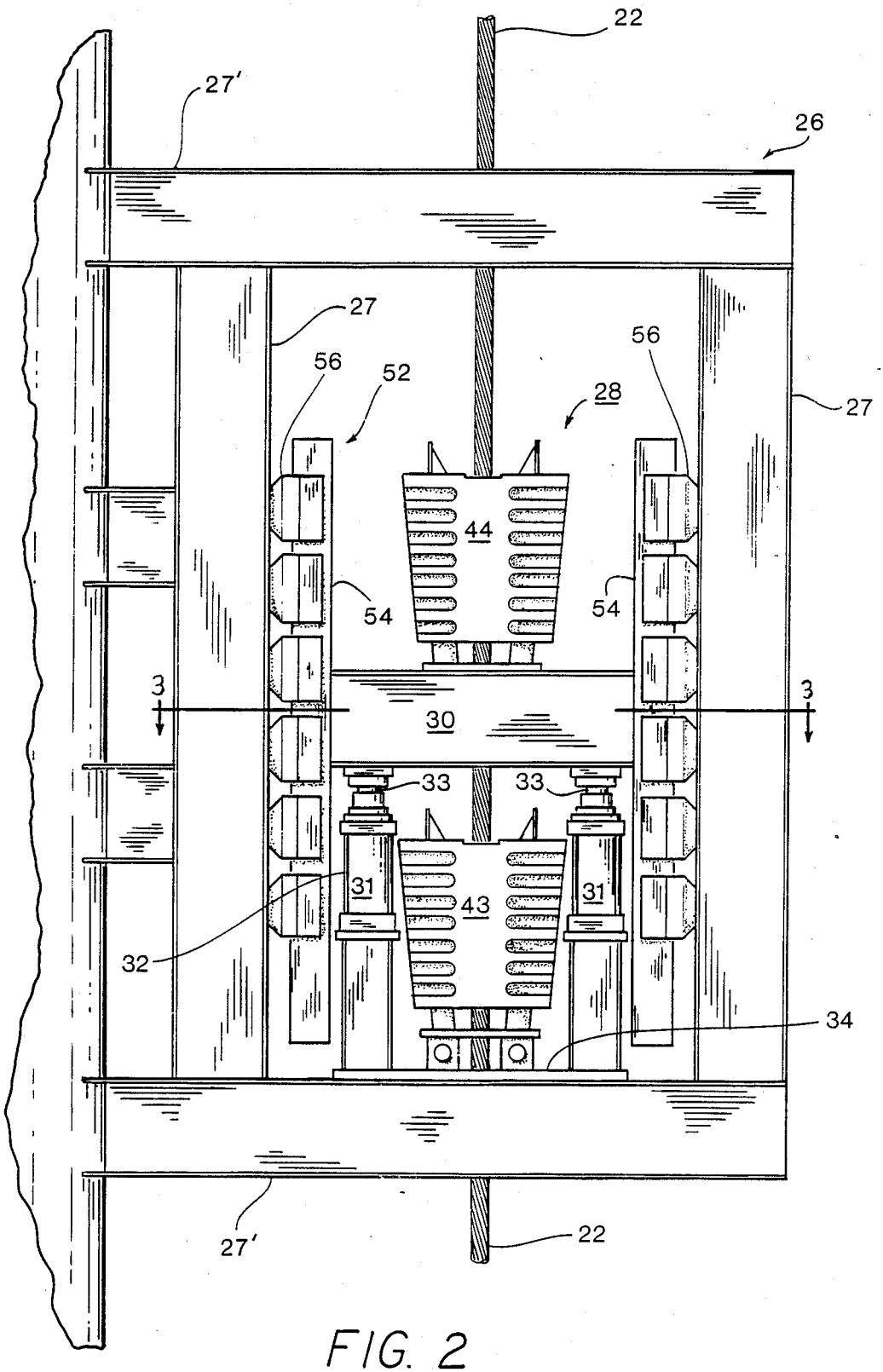
FIG. 2 is a schematic side elevation view of a preferred embodiment of the novel mooring cable tensioning and damping system of the present invention.
Figure 3:
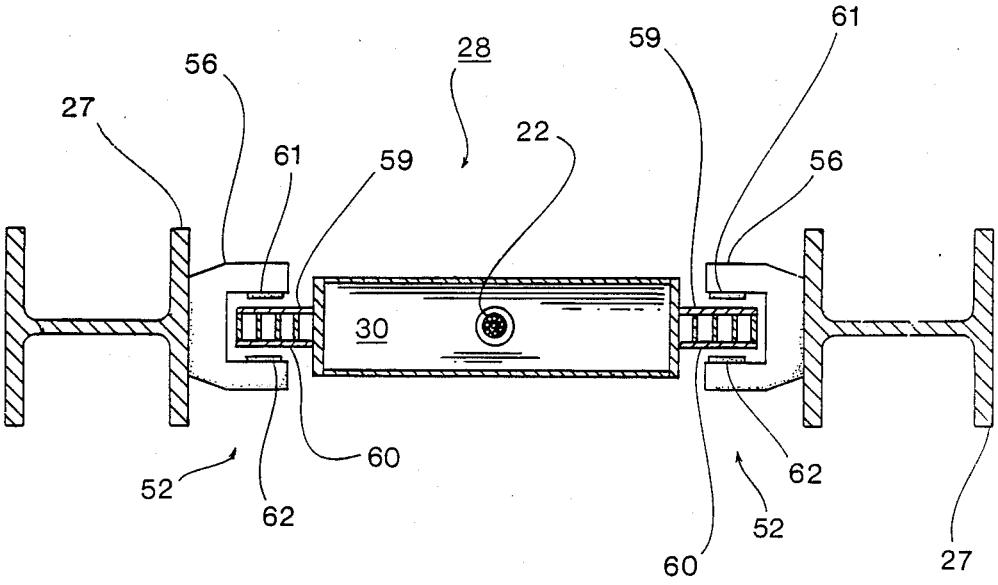
FIG. 3 is a sectional view taken on line 3—3 of FIG. 2.

The low-motion, column-stabilized, deep-drafted, floating, production platform 10 (FIGS. 1–2) has a fully-submersible lower hull 11, an above-water, upper hull 12, and an upper deck 13. Lower hull 11 together with large cross-section, hollow, buoyant, stabilizing, vertical columns 14 support, at an elevation above the maximum expected wave crests, the entire weight of upper hull 12 and its maximum deck load.

Platform 10 is especially useful for conducting hydrocarbon production operations in relatively deep waters over a seabed site 16 which contains submerged oil and/or gas producing wells 17. By virtue of the platform's relatively low-motion responses to the wave actions, surface-type, production wellhead trees (not shown) can be suspended from upper hull 12 above waterline 18.

Each wellhead tree is coupled to a suitable production riser 19, the lower end of which is tied to a submerged well 17. The wellhead tree includes valves and tools for controlling fluid flow through riser 19. Each individual riser 19 and its associated wellhead are suspended above waterline 18 from a dynamic tensioner system (not shown), such as described in U.S. Pat. Nos. 4,733,991, 4,379,657 and 4,215,950.

In use, platform 10 is moored over production location 16 by a spread-type mooring line system 20 which is primarily adapted to resist horizontal and yaw motions of the platform. A typical such mooring line system 20 includes one or more very-long mooring lines 21, each typically consisting of a cable 22 extending from a powered spool 23 on deck 13, through a pulley 15 on a column 14, and thence extending downwardly and outwardly toward seabed 16. Cable 22 is followed by a long and very heavy chain 24 lying on the seabed. The outer end of chain 24 is tied to a strong anchor schematically represented as 25. At a convenient location below spool 23 (FIG. 2) is diagrammatically illustrated a support framework 26 made up of longitudinal and transverse structural members 27,27', respectively.

Framework 26 supports a winch or its equivalent, such as a hydraulically-operated linear winch 28 of a known type, or its equivalent, which can be purchased, for example, from Amclyde International of St. Paul Minn. Other linear winches are described, for example, in U.S. Pat. Nos. 4,615,509 and 4,427,180.

Each cable 22 is deployed and pulled in by winch 28 which includes a dynamic loadbeam 30 through the center of which mooring cable 22 passes. Loadbeam 30 is movably supported by a pair of double-acting rams 31 having cylinders 32 and piston-rods 33. The bottoms of cylinders 32 are supported by a base plate 34 secured to structural transverse member 27'. Dynamic loadbeam 30 and base plate 34 are perpendicular to the longitudinal axis of cable 22.

Figure 4:
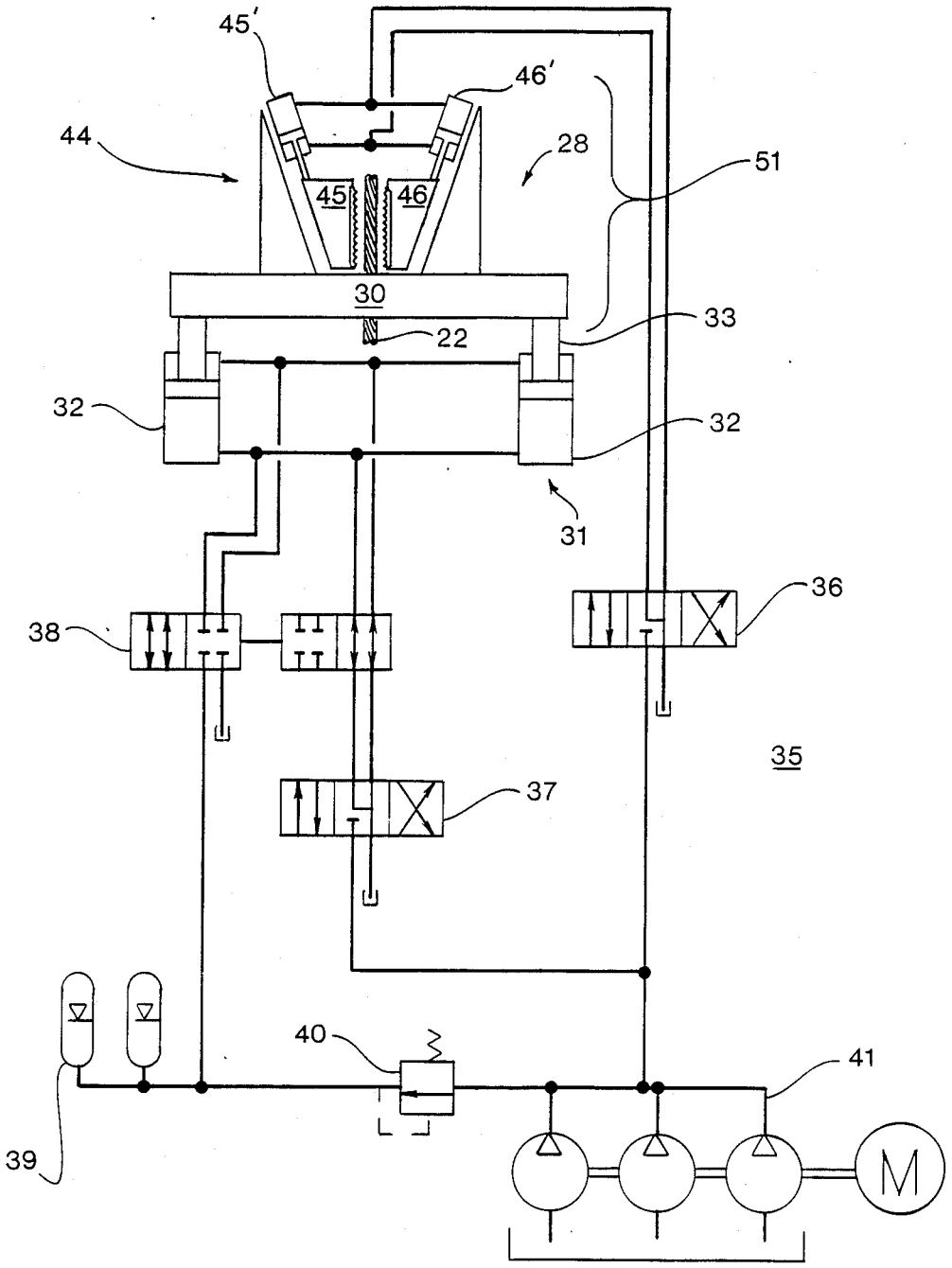
FIG. 4 is a diagrammatic representation of the hydraulic network used to activate the mooring cable dynamic tensioner shown in FIG. 2.

In each cylinder 32, piston-rod 33 reciprocates in response to fluid pressure from a hydraulic network 35 (FIG. 4), which includes: valves 36 and 37, a tandem valve 38, a hydraulic-fluid accumulator bank 39, a flow regulator 40, and a hydraulic pump unit 41.

Winch 28 further includes a pair of cable grippers on the opposite sides of dynamic loadbeam 30: a static gripper 43 on base plate 34 between rams 31, and a dynamic gripper 44 which rests on top of and moves with dynamic loadbeam 30. Internally, each gripper may include two wedge-shaped gripping jaws 45,46 through and between which cable 22 can freely pass. Jaws 45,46 are activated by hydraulic cylinders 45',46', respectively.

In operation, when jaws 45,46 in grippers 43, 44 selectively grip cable 22, they cooperate by friction to incrementally deploy or pull the cable in. For example, when normally-static gripper 43 is activated by fluid action applied to its hydraulic cylinders 45',46', its jaws 45,46 grip cable 22 while rams 31 are retracted.

When it is desired to pull cable 22 in, then, in sequential order, dynamic gripper 44 is activated and its jaws 45,46 grip cable 22, static gripper 43 is deactivated and its jaws 45,46 release cable 22, rams 31 are activated to lift loadbeam 30 and its associated dynamic gripper 44 by a predetermined distance (say by 1 meter), static gripper 43 is reactivated and its jaws 45,46 grip cable 22, dynamic gripper 44 is deactivated and its jaws 45,46 release cable 22, and finally rams 31 are deactivated to retract loadbeam 30 to its rest position. This complete cycle can be repeated as often as is necessary.

Similar pulling in operations are simultaneously performed on the remaining cables 22, if any, of mooring line system 20 to bring floating platform 10 to the desired position. The description so far of mooring line system 20 and of its winches 28 is known art.

The Tensioning and Damping System of the Invention

The objects of the present invention include the use of winch 28, or its equivalent, not only for (a) deploying and (b) pulling in the mooring cable, but also for (c) maintaining a predetermined tension in mooring cable 22 under dynamic sea conditions, for (d) reducing the spring stiffness of the mooring system, thereby increasing the natural periods of oscillation of the pitch, roll, heave, surge, sway, and yaw motions of the moored floating structure, and for (e) producing anti-motion forces on platform 10, which are calculated to achieve a substantial decrease in the amplitude of a particular linear or angular motion, especially when the platform is about to approach the resonance state for that particular motion.

Under normal sea and environmental conditions, cable 22 is restrained by static gripper 43 whose two jaws 45,46 grip cable 22, while rams 31 are retracted.

In anticipation of a storm, dynamic gripper 44 is activated through valve 36 and its jaws 45,46 grip cable 22, and then static gripper 43 is deactivated so that its gripping jaws 45,46 release cable 22. Then, tandem valve 38 (FIG. 4) is shifted from its normal position to its activated position, whereupon valve 37 becomes isolated, and the output from hydraulic-fluid accumulator bank 39, which is supplied from a pump unit 41 via a control regulator 40, is directed into the lower ends of cylinders 32 in rams 31.

As platform 10 cyclically heaves up and down during each oscillatory cycle, hydraulic fluid is alternately pushed in and out of cylinders 32. As a result, dynamic assembly 51, consisting of gripper 44, loadbeam 30, and cable 22, acquires heave motion relative to platform 10.

For any position along their strokes, piston-rods 33 in rams 31 will apply a continuous, substantially-constant, predetermined, upward-acting force on loadbeam 30, which will increase the dynamic tension in cable 22. This dynamic tension can be on the order of 200 tons or more for a platform 10 of the type above described. It will be apparent, therefore, that linear winch 28 acts in a storm as a dynamic mooring cable tensioner for compensating the tension in cable 22 and for reducing the spring stiffness of mooring system 20, which results in a corresponding increase in the natural periods of oscillation of the pitch, roll, heave, surge, sway, and yaw motions of the moored floating structure 10.

Preferably, linear winch 28 is also provided with a damping system 52 which is operatively coupled between dynamic loadbeam 30 and framework 26 which extends outwardly from platform 10.

For that purpose, the opposite ends of dynamic loadbeam 30 carry fins 54, each extending longitudinally and being made of a long, flat metal bar defining opposite polished surfaces 59,60. Fins 54 are preferably secured by bolts to the opposite ends of load beam 30 and are therefore replaceable.

Each longitudinal structural member 27 opposite to an end of dynamic loadbeam 30 supports an array of linear caliper brakes 56, each brake carrying pads 61,62 adapted to frictionally bear against the opposite, polished surfaces 59,60 of fin 54.

Linear brakes 56 are operated by hydraulic power means (not shown) under the control of instrumentation modules, each being responsive to sensors (not shown) for the purpose of controlling the braking action thereof. These sensors include motion sensors and load sensors on brake pads 61,62.

In operation, damping system 52 will be activated in anticipation of a very severe storm. Pads 61,62 of caliper brakes 56 will selectively apply frictional forces against fins 54 only when platform 10 heaves upward. These frictional forces develop corresponding downward-acting, anti-motion forces on platform 10 which are substantially constant and independent of the velocity of the platform's displacements. These frictional forces (Coulomb friction) dissipate energy as soon as platform 10 starts to heave up, and then brakes 56 are deactivated as soon as platform 10 starts to heave down. Consequently, the anti-motion forces will assist in maintaining, within acceptable limits, the resonant motion responses of platform 10 to wave energies exceeding the maximum expected wave periods in a design seaway.

Since the frictional forces are produced by mechanical brakes 56, the motion energy pumped into platform 10 by the sea waves is converted into heat energy or is stored as potential energy due to draft changes. This heat energy can be absorbed by platform 10, by heat exchangers, or by circulating sea water through fins 54.

It will be apparent that the opposite ends of dynamic loadbeam 30 can carry the brakes 56, and each longitudinal structural member 27 opposite to an end of dynamic loadbeam 30 can support the linear fin 54. It will be further apparent that other variations are possible without departing from the scope of the invention.

What is claimed is:

1. A column-stabilized floating structure, comprising:

a fully-submersible lower hull, an above-water, upper hull, an upper deck, and hollow, buoyant, stabilizing, vertical columns between said upper and lower hulls;

a spread-type mooring system having a predetermined spring stiffness for anchoring said structure to the seabed, said mooring system including at least one mooring cable;

a framework on said structure for each mooring cable;

a hydraulically-operated tensioner system, including winch means and extensible, double-acting ram means, supported by said framework, said tensioner system being adapted for selectively deploying, pulling in, and maintaining a continuous, substantially-constant, predetermined tension in said mooring cable, as said floating structure responds to cyclic wave forces under dynamic sea conditions, and said tensioner system reducing said spring stiffness of said mooring system, thereby increasing the natural periods of oscillation of the pitch, roll, heave, surge, sway, and yaw motions of the moored floating structure.

2. A floating structure according to claim 1, wherein said winch means includes a linear winch;

a loadbeam supported by said ram means, and a dynamic gripper means supported by said loadbeam for vertical movement with said ram means; and said mooring cable extending through said dynamic gripper means.

3. A floating structure according to claim 2, and a static gripper means mounted on said framework below said beam, and said mooring cable extends through said static gripper means.

4. A floating structure according to claim 3, wherein each gripper means includes two hydraulically-operated wedge-shaped gripping jaws for selectively gripping said mooring cable; and a hydraulic source having means for selectively feeding and receiving pressurized fluid to and from said rams means and said dynamic and static gripper means.

5. A floating structure according to claim 4, and motion damping means coupled between said loadbeam and said framework for selectively frictionally damping the upward vertical displacements of said framework relative to said dynamic gripper means.

6. A floating structure according to claim 5, wherein said damping means include hydraulically-operated linear brakes and longitudinal fins having flat surfaces against which said linear brakes selectively exert frictional forces; and said brakes and said fins having relative vertical motion.

7. A floating structure according to claim 6, wherein said fins move with said framework.

8. A floating structure according to claim 6, wherein said brakes extend outwardly and longitudinally from said framework and move therewith.

9. A floating structure according to claim 8, wherein said fins extend outwardly and longitudinally from the opposite ends of said beam and move therewith.

10. A floating structure according to claim 7, wherein said brakes extend outwardly and longitudinally from the opposite ends of said beam and move therewith.

11. A floating structure according to claim 9, wherein said floating structure is a production platform;

said mooring cable includes a chain having an inner end coupled to said mooring cable and an outer end anchored to the seabed;

said static gripper means is normally activated to grip said mooring cable when said structure is subjected to relatively small sea waves; and said static gripper means is deactivated to release said mooring cable when said structure is subjected to relatively high waves, said dynamic gripper means is activated to grip said mooring cable, and said brakes are activated to exert frictional forces against said fin surfaces, thereby damping the vertical displacements of said platform.

12. A floating structure, comprising:

a spread-type mooring system having a predetermined spring stiffness for anchoring said structure to the seabed, said mooring system including at least one mooring cable;

a framework on said structure for each mooring cable;

a tensioner system supported by said framework, said tensioner system including:

ram means;

a loadbeam supported by said ram means;

a dynamic gripper means supported by said loadbeam for vertical movement with said ram means;

a static gripper means mounted below said loadbeam;

said mooring cable extending through said static gripper means, through said loadbeam and through said dynamic gripper means; and said tensioner system being adapted for selectively deploying, pulling in, and maintaining a continuous, substantially-constant, predetermined tension in said mooring cable, as said floating structure responds to cyclic wave forces under dynamic sea conditions, and said tensioner system reducing said spring stiffness of said mooring system, thereby increasing the natural periods of oscillation of the pitch, roll, heave, surge, sway, and yaw motions of the moored floating structure.

13. A floating structure according to claim 12, and motion damping means coupled between said loadbeam and said structure for selectively frictionally damping the upward vertical displacements of said structure relative to said dynamic gripper means.

* * * * *